US010816308B2

(12) United States Patent
Araki et al.

(10) Patent No.: US 10,816,308 B2
(45) Date of Patent: Oct. 27, 2020

(54) FIRING CONTROL SYSTEM AND FIRING CONTROL METHOD

(71) Applicant: MITSUBISHI HEAVY INDUSTRIES, LTD., Tokyo (JP)

(72) Inventors: Shunsuke Araki, Tokyo (JP); Keisuke Ando, Tokyo (JP); Yasuhiro Toyoda, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 240 days.

(21) Appl. No.: 15/896,575

(22) Filed: Feb. 14, 2018

(65) Prior Publication Data

US 2020/0158472 A1 May 21, 2020

(30) Foreign Application Priority Data

Sep. 5, 2017 (JP) ..... 2017-169983

(51) Int. Cl.
*F41G 7/22* (2006.01)

(52) U.S. Cl.
CPC ..... *F41G 7/2206* (2013.01); *F41G 7/2233* (2013.01); *F41G 7/2286* (2013.01)

(58) Field of Classification Search
CPC ..... F42B 15/10; F41G 7/2206; F41G 7/2233; F41G 7/2286; F41G 7/007; F41G 3/04
USPC ..... 342/25
See application file for complete search history.

(56) References Cited

U.S. PATENT DOCUMENTS 4,307,650 A * 12/1981 Kuesters ..... F41F 3/06 89/1.56
9,671,200 B1 * 6/2017 Anderson ..... F41H 11/02
2009/0326893 A1 * 12/2009 Neely ..... G08G 5/0034 703/8
2011/0226889 A1 * 9/2011 Rovinsky ..... F41G 7/007 244/3.11
2012/0068000 A1 * 3/2012 Goldner ..... F41H 11/02 244/3.16

FOREIGN PATENT DOCUMENTS

JP 2003-139500 5/2003

* cited by examiner

*Primary Examiner* — Frank J McGue
(74) *Attorney, Agent, or Firm* — Wenderoth, Lind & Ponack, L.L.P.

(57) ABSTRACT

A threat degree of each of targets is numerized based on data obtained by observing the targets after launching of the flying objects. Also, the firepower of flying object is numerized based on the state of flying object after the launching. The optimal assignment of firepower is calculated based on the numerized threat degrees and firepower, and is shared by the flying objects. Each flying object intercepts the target specified based on the optimal assignment.

12 Claims, 9 Drawing Sheets

FIRING CONTROL SYSTEM AND FIRING CONTROL METHOD

TECHNICAL FIELD

The present invention relates to a firing control system and a firing control method, in which a target is intercepted by a flying object.

BACKGROUND ART

There is a case that after a flying object is launched to intercept a target in a distant place, detailed data of the target is acquired. However, the already launched flying object continues to fly according to a condition set before the launching. Therefore, the condition that the flying object meets the target has been set based on old data before the launching.

Especially, when a plurality of targets should be intercepted by a plurality of flying objects, the more efficient interception can be expected if the firepower assignment determining which of the flying objects intercepts one of the targets can be optimized based on the latest information obtained by observing the targets. It is expected that the larger effect is accomplished through the optimization of the firepower assignment as the range of the flying object becomes longer, in other words, when a time from the launching of the flying object to the meeting with the target becomes longer.

In conjunction with the above, Patent Literature 1 (JP_2003-139500A) discloses a guided flying object and an aircraft. This guided flying object has a seeker which can identify a plurality of targets individually, and a communication device which transmits data of the number of targets identified by the seeker to a mother machine. Here, the communication device may transmit the data of the targets to another guided flying object. The guided flying object may further have a seeker control unit. The seeker control unit controls the seeker to pursue a target different from the target pursued by another guided flying object based on data of target received from the other guided flying object.

CITATION LIST

[Patent Literature 1] JP 2003-139500A

SUMMARY OF THE INVENTION

A firing control system and a firing control method are provided in which the assignment of a plurality of flying objects to a plurality of targets can be optimized after launching the flying objects to intercept the targets. Other problems and new features will become clear from this Specification and the attached drawings.

A firing control system in one embodiment includes a launcher apparatus, a plurality of flying objects, a sensor device and a first processing unit. Here, the plurality of flying objects are launched for the plurality of targets from the launcher apparatus. The sensor device observes the plurality of targets.

The first processing unit calculates the optimal assignment of the plurality of flying objects to the plurality of targets based on the result of the observation. Each of the plurality of flying objects includes a first communication device and a second processing unit. Here, the first communication device receives a first data signal which contains the optimal assignment calculated by the first processing unit. The second processing unit sets one of the plurality of targets which is specified through the optimal assignment, as an interception object.

The firing control method in one embodiment includes a launcher apparatus launching a plurality of flying objects for a plurality of targets; a sensor device observing the plurality of targets; a first processing unit calculating an optimal assignment of the plurality of flying objects to the plurality of targets based on the result of the observation; each the plurality of flying objects receiving first data signal which contains data showing the optimal assignment; each of the plurality of flying objects setting an interception object to one of the plurality of targets which is specified by the optimal assignment.

According to the one embodiment, the assignment of firepower of flying objects to the targets can be optimized after the flying objects are launched for the targets.

DESCRIPTION OF THE EMBODIMENTS

A firing control system and a firing control method according to embodiments of the present invention will be described below with reference to the attached drawings.

First Embodiment

Figure 1A:
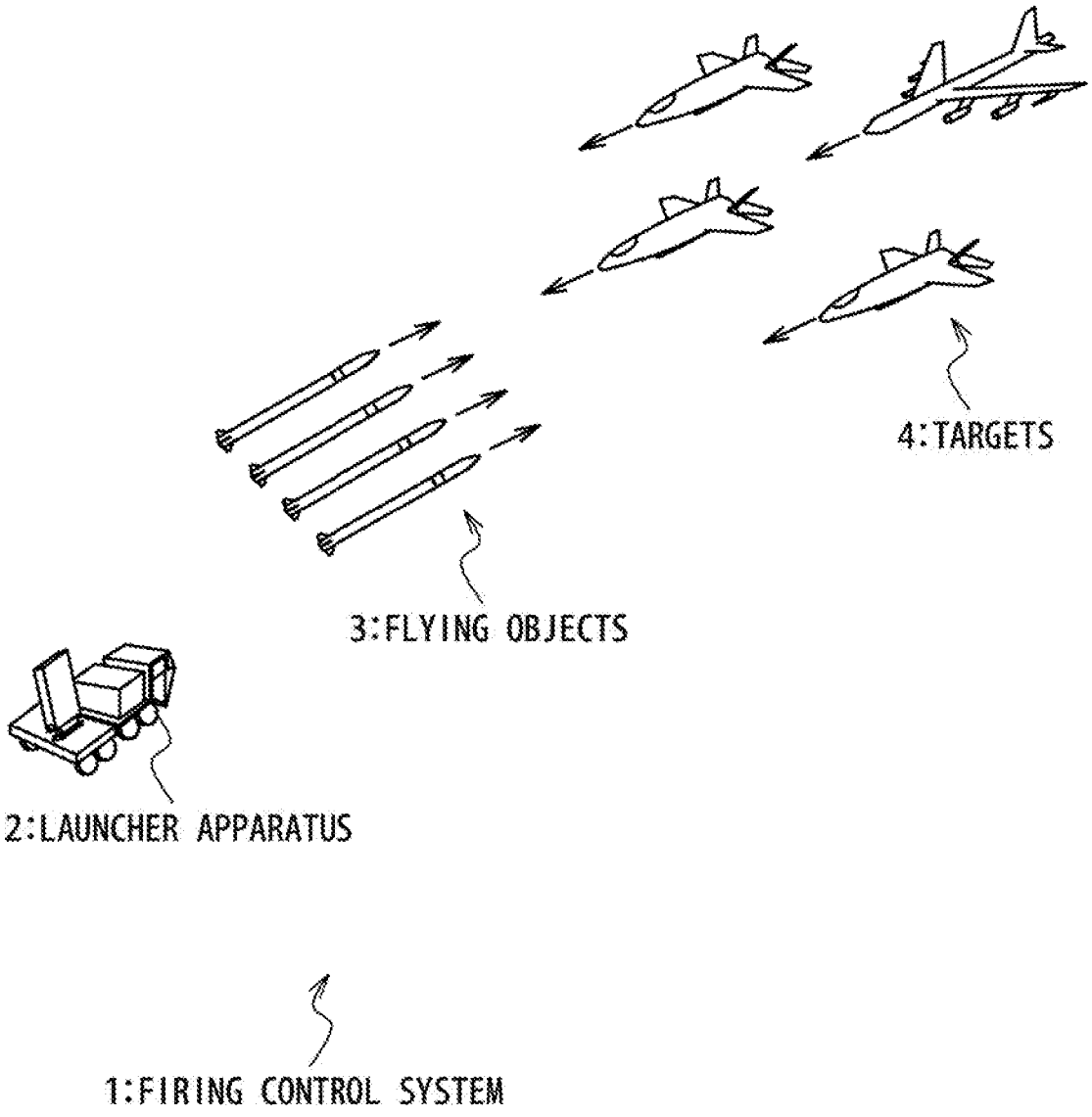
FIG. 1A is a diagram showing a configuration example of a firing control system in a first embodiment.

Referring to FIG. 1A, a configuration example of the firing control system 1 according to a first embodiment of the present invention will be described.

The firing control system 1 shown in FIG. 1A has a launcher apparatus 2 and a plurality of flying objects 3. In a state shown in FIG. 1A, the plurality of flying objects 3 are launched for the plurality of targets 4 from the launcher apparatus 2. For example, the plurality of targets 4 may be aircrafts flying in formation and approaching for the launcher apparatus 2.

Here, it is not always necessary for the plurality of flying objects 3 to have identical firepower. That is, the plurality of flying objects 3 of different models may be used. Also, even if the plurality of flying objects are of the same model, the firepower of the flying objects 3 may differ, depending on an individual difference, a manufacturing lot and so on. In this case, a dynamic performance of a rocket motor, a destructive force of a warhead and so on of the flying object 3 are numerized to values, which are weighted appropriately and then totalized to a total value of the firepower of flying object 3. Thus, the flying object 3 can be compared with another flying object with respect to the firepower.

In the same way, the threat of the plurality of targets 4 may not be always identical. That is, aircrafts of a plurality of different models may be mixed in the plurality of targets 4. Also, even if the aircrafts are of the same model, there may be an individual difference, a difference of the ability of a pilot and a difference of role in the formation in each of the plurality of targets 4. Here, an RCS (Radar Cross Section), a turning acceleration, a position in formation, a speed vector and so on of each target 4 are numerized to values, which are weighted appropriately and totalized to a value. Thus, the target 4 can be compared with another target or the flying object with respect to the threat.

In such a situation, to maximize an interception efficiency of the plurality of targets 4 by the plurality of flying objects 3, it is considered to optimize the firepower assignment of the plurality of flying objects 3 to the plurality of targets 4. The maximization of interception efficiency due to the firepower assignment can be realized by an algorithm by which the flying object 3 having a stronger firepower of the plurality of flying objects 3 is assigned to the target 4 having a higher threat degree of the plurality of targets 4. Note that this algorithm is only an example, and other algorithm is not excluded.

The firing control system 1 in the present embodiment can optimize the firepower assignment of the plurality of flying objects 3 to the plurality of targets 4 after the plurality of flying objects 3 are launched for the plurality of targets 4 from the launcher apparatus 2.

Figure 1B:
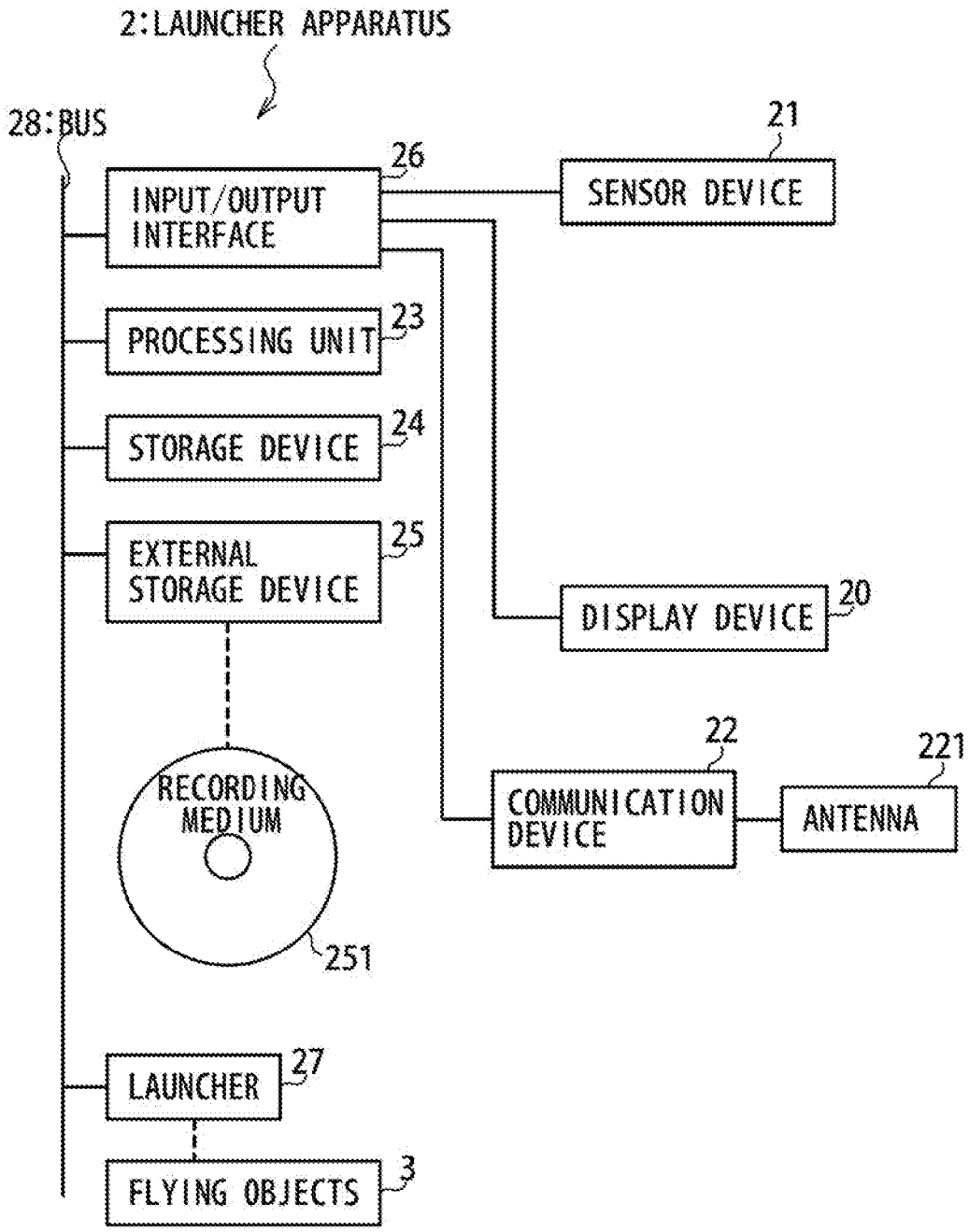
FIG. 1B is a block diagram schematically showing a configuration example of a launcher apparatus in the first embodiment.

Referring to FIG. 18, a configuration example of the launcher apparatus 2 in the first embodiment will be described. FIG. 1B is a block diagram schematically showing the configuration example of the launcher apparatus 2 in the first embodiment.

The configuration of launcher apparatus 2 will be described. The launcher apparatus 2 has a bus 28, an input/output interface 26, a sensor device 21, a display device 20, a communication device 22, an antenna 221, a processing unit 23, a storage device 24, an external storage device 25 and a launcher 27.

The connection relation of components of the launcher apparatus 2 will be described. The input/output interface 26, the processing unit 23, the storage device 24, the external storage device 25 and the launcher 27 are connected through bus 28 to be communicable with each other. The sensor device 21, the display device 20 and the communication device 22 are connected with the input/output interface 26. Note that part or the whole of the sensor device 21, the display device 20 and the communication device 22 may be directly connected with the bus 28 without passing through the input/output interface 26. The antenna 221 is connected with the communication device 22. The external storage device 25 is connected with recording medium 251 detachably. The launcher 27 is connected with the flying object 3 detachably.

The operation of components of the launcher apparatus 2 will be described. The bus 28 mediates communication between the components connected with the bus 28. The input/output interface 26 mediates communication between the components connected with the input/output interface 26. The storage device 24 stores a predetermined program, predetermined data and so on. The program and the data may be provided from the recording medium 251 through the external storage device 25 and may be provided from outside through the communication device 22 or the sensor device 21. The processing unit 23 reads the program from the storage device 24 to execute it, inputs and outputs the data stored in the storage device 24 and controls the sensor device 21, the display device 20, the communication device 22, the launcher 27 and so on. The sensor device 21 observes a peripheral situation of the launcher apparatus 2, especially, the targets 4 and the launched flying objects 3 and stores the observation result in the storage device 24 or notifies to the processing unit 23. The communication device 22 carries out the radio communication with the flying objects 3 and with another communication object through the antenna 221. The display device 20 visibly displays the result calculated by the processing unit 23 and the data stored in the storage device 24 and so on. Note that the display device 20 may output an acoustic signal and so on in addition to an optical signal. The launcher 27 launches the flying objects 3 under the control of the processing unit 23.

Figure 1C:
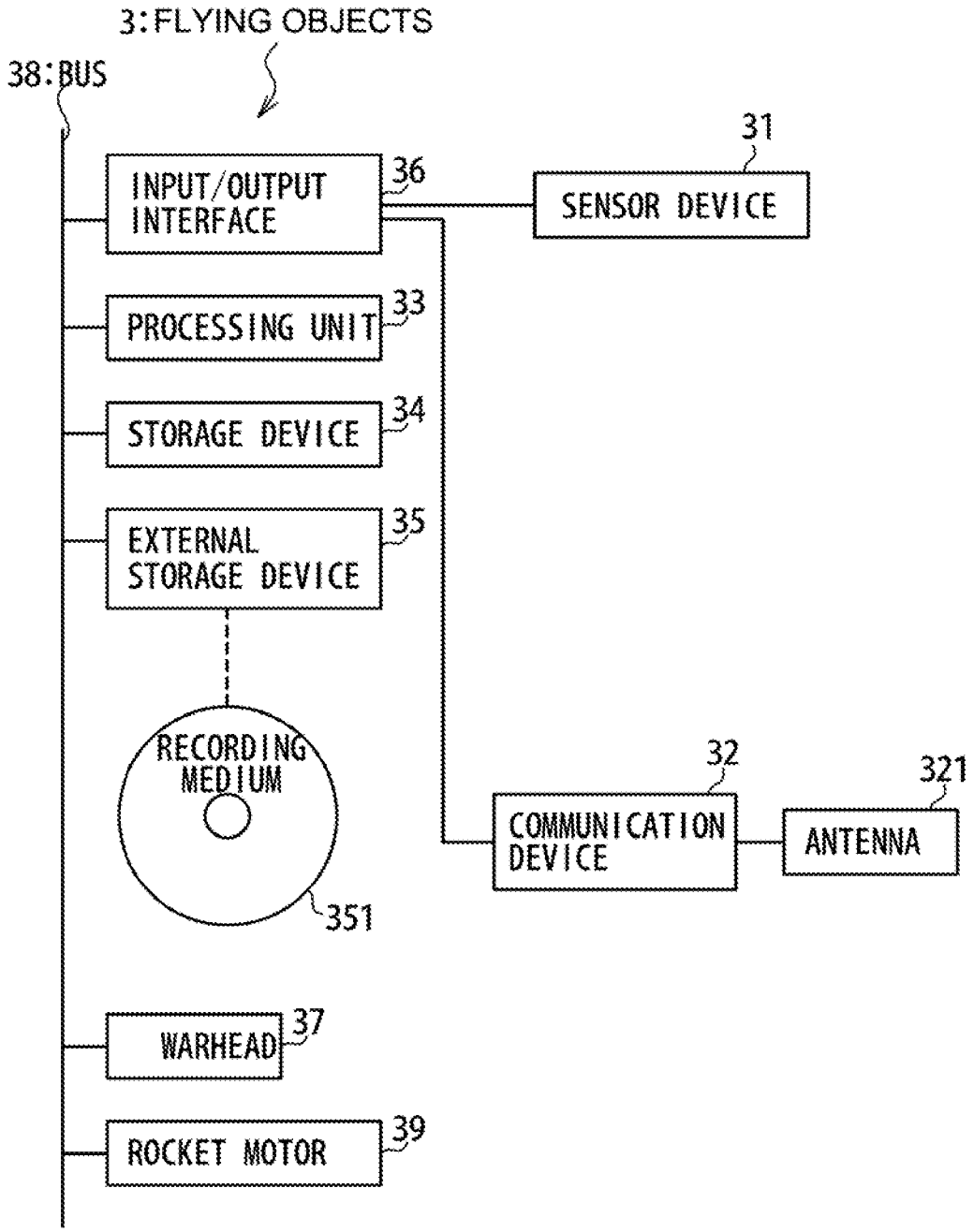
FIG. 1C is a block diagram schematically showing a configuration example of a flying object in the first embodiment.

Referring to FIG. 1C, a configuration example of the flying object 3 in the first embodiment will be described. FIG. 1C is a block diagram schematically showing the configuration example of the flying object 3 in the first embodiment.

Components of the flying object 3 will be described. The flying object 3 includes a bus 38, an input/output interface 36, a sensor device 31, a communication device 32, an antenna 321, a processing unit 33, a storage device 34, an external storage device 35, a warhead 37 and a rocket motor 39.

The connection relation of components of the flying object 3 will be described. The input/output interface 36, the processing unit 33, the storage device 34, the external storage device 35, the warhead 37 and the rocket motor 39 are connected through the bus 38 communicably each other. The sensor device 31 and the communication device 32 are connected with the input/output interface 36. Note that part or whole of the sensor device 31 and the communication device 32 may be directly connected with the bus 38 without passing through the input/output interface 36. The antenna 321 is connected with the communication device 32. The external storage device 35 is connected with the recording medium 351 detachably.

The operation of components of the flying object 3 will be described. The bus 38 mediates communication between the components connected with the bus 38. The input/output interface 36 mediates communication among the components connected with the input/output interface 36. The storage device 34 stores a predetermined program, predetermined data and so on. This program and the data may be provided from a recording medium 351 through the external storage device 35 and may be provided from outside through the communication device 32 or the sensor device 31. The processing unit 33 reads the program from the storage device 34 to execute it, inputs and outputs the data stored in storage device 34 and controls the sensor device 31, the communication device 32, the warhead 37, the rocket motor 39 and so on. The sensor device 31 observes the peripheral situation of the flying object 3, especially, the targets 4, stores the observation result in the storage device 34 or notifies to the processing unit 33. The communication device 32 carries out radio communication with the launcher apparatus 2, the other communication objects and so on through the antenna 321. The warhead 37 and the rocket motor 39 operate appropriately under the control of the processing unit 33.

Figure 2:
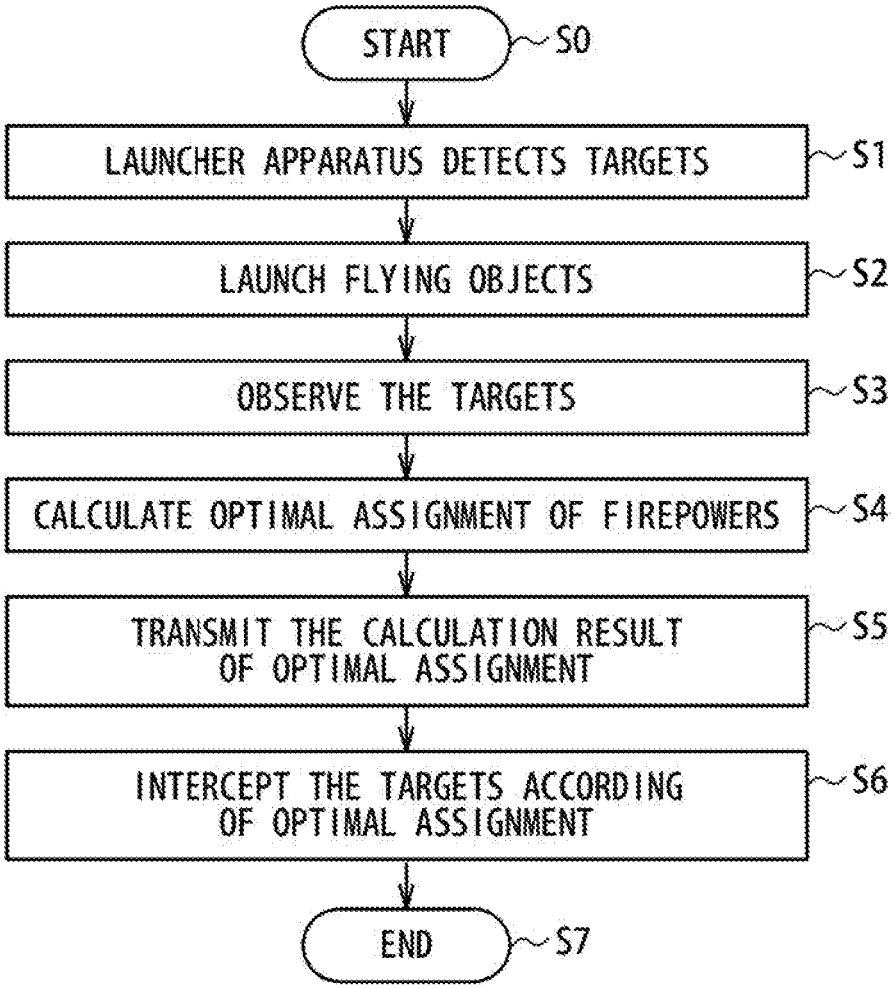
FIG. 2 is a flow chart showing a configuration example of a firing control method in the first embodiment.

Referring to FIG. 2, an example of the operation of the firing control system 1 in the first embodiment, i.e. the firing control method in the first embodiment will be described. FIG. 2 is a flow chart showing an example of the firing control method in the first embodiment.

The flow chart of FIG. 2 includes steps from step S0 to step S7. The flow chart of FIG. 2 begins from the step S0. After the step S0, the step S1 is executed.

When the first step S1 is executed, the launcher apparatus 2 detects the targets 4 as an object to be intercepted. At this time, the launcher apparatus 2 may detect the targets 4 observed by the sensor device 21 and may receive data of the targets 4 notified externally through the communication device 22.

Figure 3A:
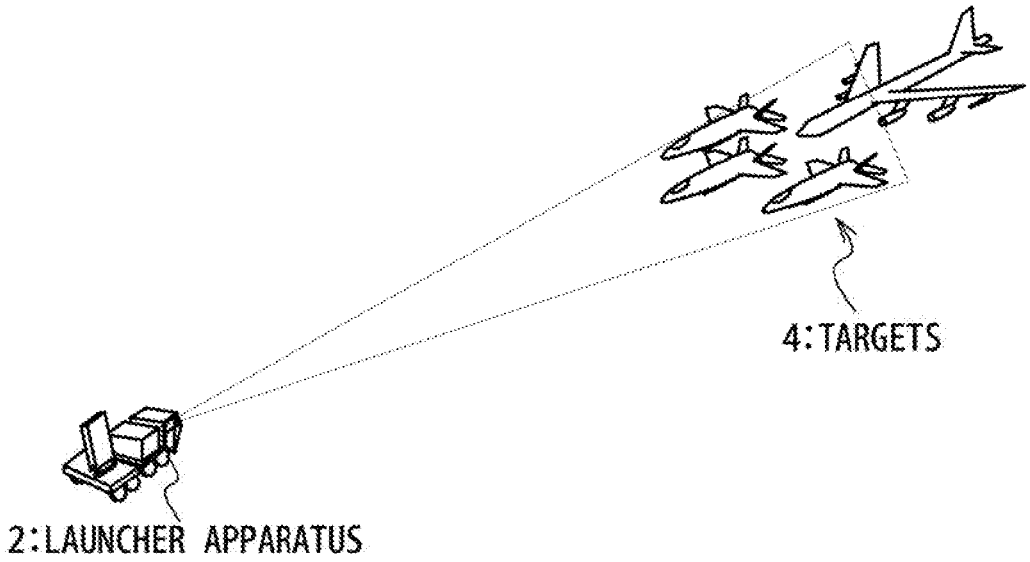
FIG. 3A is a diagram showing a first state of the launcher apparatus in the first embodiment.
Figure 3B:
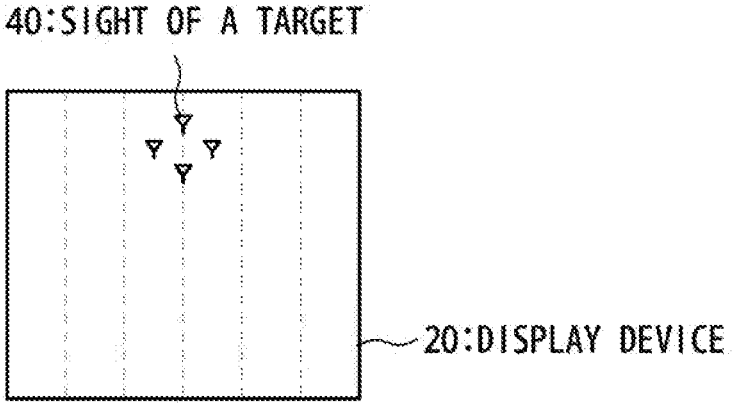
FIG. 3B is a diagram showing an example of data which the launcher apparatus in the first state displays on a display device when observing the targets.

Referring to FIG. 3A and FIG. 3B, the state of the launcher apparatus 2 which has detected the plurality of targets 4 located on a distant place will be described. FIG. 3A is a diagram showing a first state of the launcher apparatus 2 in the first embodiment. In an example of FIG. 3A, the targets 4 are not in an area sufficiently near the launcher apparatus 2.

FIG. 3B is a diagram showing an example of data of the targets 4 observed and acquired by the launcher apparatus 2 in the first state and displayed on the display device 20. Because the targets 4 are not in the area sufficiently near the launcher apparatus 2, the sensor device 21 cannot acquire the data of targets 4. It is possible to know from the display device 20 that the four targets 4 are in formation.

The control advances to a second step S2 after the first step S1.

At the second step S2, the launcher apparatus 2 launches the flying objects 3 for the targets 4. At this time, it is desirable that the processing unit 23 executes the program of the storage device 24 to appropriately control the launcher 27 to launch the flying objects 3 of the same number as that of the targets 4 for interception of the four targets 4. Also, it is desirable that the processing unit 23 transmits the target data showing the targets 4 to the flying objects 3 through the launcher 27 from the storage device 24 and the flying objects 3 stores the target data in the storage device 34. After the second step S2, a third step S3 is executed.

At the third step S3, the flying object 3 observes the peripheral situation of the flying object 3, especially, the targets 4 while flying toward the target 4. At this time, it is desirable that the flying object 3 observes a position and speed of each of the targets 4. It is also desirable that the flying object 3 observes its own position and speed in addition to the data of the targets 4. The launcher apparatus 2, too, observes the peripheral situation of the launcher apparatus 2 from the viewpoint of approaching the targets 4. It is desirable that the launcher apparatus 2 observes the flying objects 3 and the targets 4, especially. However, only one of the launcher apparatus 2 and the flying object 3 may observe the targets 4 or both may observe.

Figure 4A:
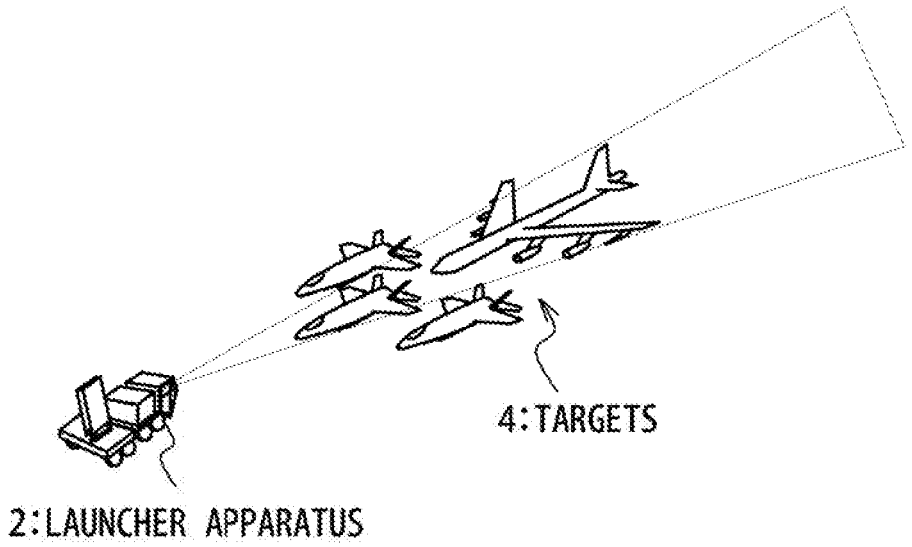
FIG. 4A is a diagram showing a second state of the launcher apparatus in the first embodiment.
Figure 4B:
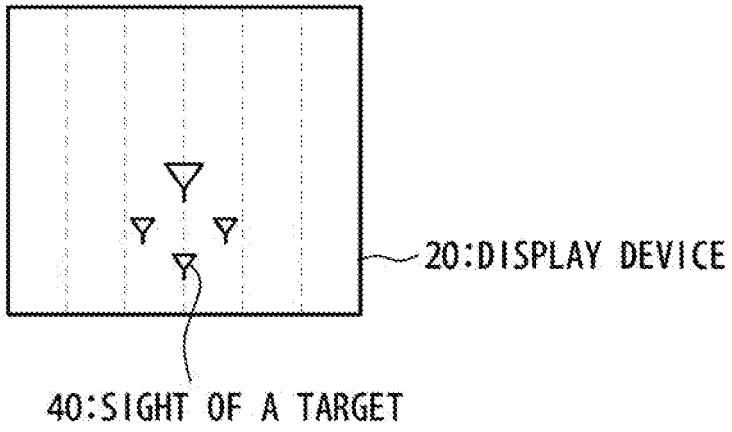
FIG. 4B is a diagram showing an example of data which the launcher apparatus in the second state displays on the display device, when observing the targets.

Referring to FIG. 4A and FIG. 4B, the state of the launcher apparatus 2 will be described when having observed the plurality of targets 4 situated in the neighborhood of the launcher apparatus 2. FIG. 4A is a diagram showing a second state of the launcher apparatus 2 in the first embodiment. In an example of FIG. 4A, the targets 4 are in an area sufficiently near the launcher apparatus 2.

FIG. 4B is a diagram showing an example of the data when the launcher apparatus 2 in the second state observes the plurality of targets 4 to display on the display device 20. Since the targets 4 are in an area sufficiently near approaching the launcher apparatus 2, the sensor device 21 can acquire the data of the targets 4 in more detail than in the first state. It is possible to see from the display device 20 that the four targets 4 are in formation and one of the four targets is larger than the remaining three.

Note that a case is shown in FIG. 4A in which only the launcher apparatus 2 observe the targets 4. However, as mentioned above, the flying object 3 may observe the targets 4. When the flying object 3 observes the targets 4, it is desirable to promptly transmit a data signal containing an observation result to the launcher apparatus 2 from the flying object 3. When displaying the data signal received from the flying object 3 on the display device 20, the launcher apparatus 2 may store the data signal in the storage device 24, and the processing unit 23 may analyze the observation result in detail. When both of the flying objects 3 and the launcher apparatus 2 observe the targets 4, it is desirable that the processing unit 23 of the launcher apparatus 2 combines the observation results received as the data signal from the flying objects 3 and the observation result acquired by the launcher apparatus 2 to improve the precision of the observation result of the targets 4.

At this time, the data to be acquired as the observation result of the targets 4 contains data used to estimate a threat degree of each of the targets 4 in addition to the position and speed of the target 4 which are necessary for the flying object 3 to reach the target 4. It is possible to calculate the threat degree of the target 4 by using an RCS, a turning acceleration, a position in formation, a speed vector and so on, as mentioned above.

A fourth step S4 is executed after the third step S3.

At the fourth step S4, the firing control system 1 calculates the optimal assignment of firepower of the flying objects 3. As mentioned above, the purpose of the optimal assignment of the firepower is to maximize the interception efficiency of the plurality of targets 4 having different threat degrees by the plurality of flying objects 3 with different firepower. Therefore, the firing control system 1 calculates the threat degrees of each of the plurality of targets 4 in a comparable form, and on the other hand, calculates the firepower of each of the plurality of flying objects 3 in a comparable form.

The processing unit 23 of the launcher apparatus 2 may carry out the optimal assignment of firepower, or the processing unit 33 of one of the flying objects 3 may carry out it it out. Or, the processing unit 33 of each of the plurality of flying objects 3 may carry it out, or the processing unit 23 of the launcher apparatus 2 and the processing unit 33 of each of the flying objects 3 may carry it out. A specific method of calculating the optimal assignment of firepower will be described later.

A fifth step S5 is executed after the fourth step S4.

At the fifth step S5, the launcher apparatus 2 or the flying object 3 which has calculated the optimal assignment transmits the calculation result to the flying objects 3. The purpose to transmit the calculation result of the optimal assignment is to share the optimal assignment by the whole firing control system 1. It is desirable that this sharing is carried out by radio communication between the communication device 22 of the launcher apparatus 2 and the communication device 32 of each flying object 3.

When a plurality of optimal assignments are calculated by the launcher apparatus 2 and the plurality of flying objects 3, it is desirable that one of the calculation results is selected, and the selected calculation result is shared by the radio communication. For example, the selection may be carried out by the launcher apparatus 2 or by any of the flying objects 3. The selected optimal assignment is transmitted to all the flying objects 3 by the radio communication. When anyone of the flying objects 3 selects, it is not necessary to transmit the optimal assignment to itself.

Note that a procedure may be added in which a user of the launcher apparatus 2 approves before transmitting the selection result to the flying objects 3.

A sixth step S6 is executed after the fifth step S5.

At the sixth step S6, the plurality of flying objects 3 intercept the plurality of targets 4 according to the optimal assignment. In other words, each of the flying objects 3 changes the interception object to the target 4 specified by the optimal assignment from the target 4 assigned in the launching according to necessity and executes the interception of the target 4. A seventh step S7 is executed after the sixth step S6, and the firing control method in this embodiment ends.

So far, each step of the firing control method by using the firing control system 1 in the present embodiment has been described. Next, a specific method of the optimal assignment to be carried out at the fourth step S4 will be described. In the calculation of the optimal assignment, a threat degree of each of the targets 4 is calculated, the firepower of each of the flying objects 3 is calculated, and a combination of the target 4 and the flying object 3 is determined based on the calculated threat degree and firepower.

Referring to FIG. 5A to FIG. 5D, the method of calculating the threat degrees of the targets 4 will be described. As references used to numerize the threat degree of the target 4 to a value, the RCS, the turning acceleration, the position of the target in formation, the speed vector, and so on are thought of.

Figure 5A:
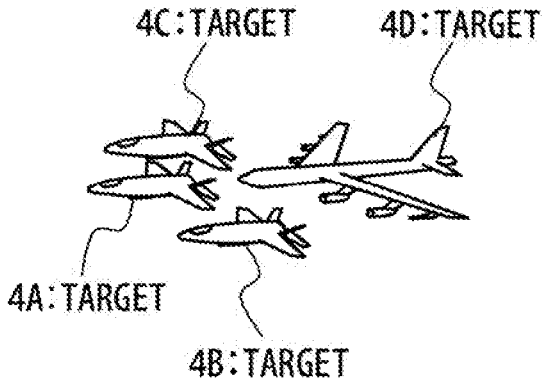
FIG. 5A is a diagram showing the calculation of a threat degree of the target based on RCS (Radar Cross Section) in the firing control system of the first embodiment.

FIG. 5A is a diagram showing the method of calculating the threat degree of the target 4 based on the RCS in the firing control system 1 in the first embodiment. The RCS is a numerical value showing the ability to reflect radio wave to a radar device from the surface of the target 4 when the target 4 receives the irradiation of the radio wave radiated from the radar device as the sensor device 21 of the launcher apparatus 2 or the sensor device 31 of the flying object 3. The RCS is determined based on the shape, size, surface material and so on of the target 4. Therefore, a type of each target 4 can be estimated by comparing the RCSs of the plurality of targets 4.

In an example of FIG. 5A, the four targets 4A to 4D are in formation. The target 4D is a so-called bomber, and the remaining three targets 4A to 4C are so-called fighters to support the target 4D. In other words, in the example of FIG. 5A, the RCS of of the target 4D is larger than the RCSs of the targets 4A to 4C.

In case of FIG. 5A, it is considered to intercept the target 4D having the larger RCS primarily. In this case, it is sufficient to carry out suitable weighting by use of a conversion function and a conversion table so that the threat degree of the target 4D becomes larger when the numerical value of RCS becomes larger. Or, oppositely, it is considered to intercept one having the smaller RCS of the targets 4A to 4C primarily. In this case, it is sufficient to carry out weighting so that the threat degree of the target 4 becomes larger when the numerical value of RCS becomes smaller.

Figure 5B:
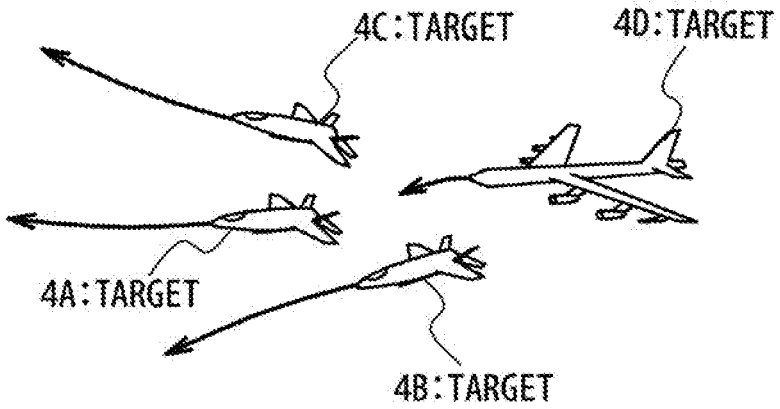
FIG. 5B is a diagram showing the calculation of the threat degree of the target based on turning acceleration in the firing control system of the first embodiment.

FIG. 5B is a diagram showing that the threat degree of the target 4 is calculated based on the turning acceleration in the firing control system 1 in the first embodiment. The turning acceleration is acceleration when the target 4 carries out a turning movement and is determined based on a radius of the turning movement, a degree of speed change and so on. In case of an aircraft, it is estimated that the aircraft can carry out a quick movement as the turning acceleration becomes larger.

In an example of FIG. 5B, the four targets 4A to 4D are in formation like the case of FIG. 5A, and the target 4D is the so-called bomber and the remaining three targets 4A to 4C are so-called fighters to support the target 4D. Then, the turning acceleration of the targets 4A to 4C is larger than the turning acceleration of the target 4D.

In case of FIG. 5B, it is considered to intercept the targets 4A to 4C having the larger turning acceleration primarily. In this case, it is sufficient to carry out suitable weighting by use of a conversion function and a conversion table so that the threat degree of each of the targets 4A to 4C becomes larger when a numerical value of the turning acceleration becomes larger. Also, oppositely, it is considered to intercept the target 4D with the smaller turning acceleration primarily. In this case, the weighting is carried out so that the threat degree of the target 4D becomes larger when the turning acceleration becomes smaller.

Figure 5C:
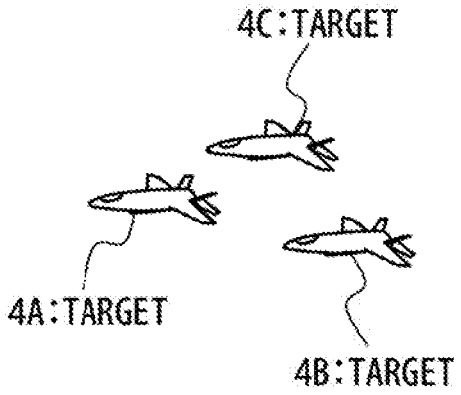
FIG. 5C is a diagram showing the calculation of the threat degree of the target based on a position of the target in formation in the firing control system of the first embodiment.

FIG. 5C is a diagram showing that the threat degree of the target 4 is calculated based on the position of the target in formation in the firing control system 1 in the first embodiment. In case that a plurality of aircrafts fly in formation, a position of the aircraft of a leader in the formation can be estimated with a degree of accuracy. For example, when three fighters are situated on the vertexes of a front-direction triangle, it can be estimated that an ace pilot is operating the leading fighter.

In an example of FIG. 5C, the three targets 4A to 4C fly in the formation of the front-direction triangle. In this case, it can be estimated that the target 4A in the leading position is a leader. By assigning a larger value to the target 4A, and assigning lower values to the remaining targets 4B and 4C, the position relation in the formation can be made values as the threat degrees.

It can be considered to primarily intercept the target 4A estimated to be the leader in FIG. 5C. In this case, it is sufficient to carry out weighting by use of a conversion function and a conversion table so that the threat degree of the target 4 becomes larger when a value showing a position in the formation becomes larger. Also, oppositely, it can be considered to primarily intercept the targets 4B and 4C which are estimated not to be the leader. In this case, it is sufficient to carry out the weighting so that the threat degree of the target 4 becomes larger when the value showing the position in the formation becomes smaller.

Figure 5D:
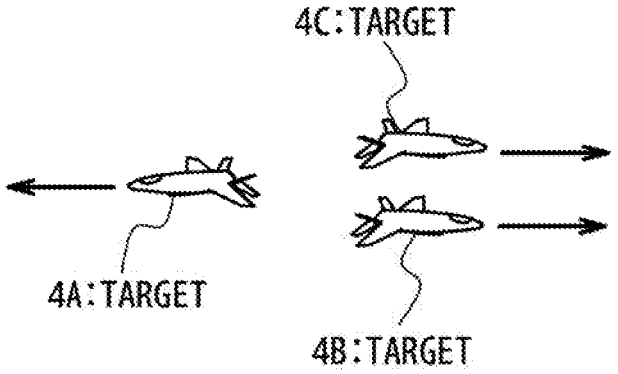
FIG. 5D is a diagram showing the calculation of the threat degree of the target based on a speed vector in the firing control system of the first embodiment.

FIG. 5D is a diagram showing that the threat degree of the target 4 is calculated based on a speed vector in the firing control system 1 in the first embodiment. Here, the speed vector represents a difference of a flying direction of the target 4. For example, there is a case that a fighter which has completed an operational action returns promptly to a base while leaving the consort plane which continues the operational action. In such a case, it can be considered that the flying direction of the returning fighter and the flying direction of the consort plane which continues the operational action are opposite to each other.

In an example of FIG. 5D, the target 4A continues a forward movement whereas the targets 4B and 4C go on one's way home. In this case, it can be estimated that the target 4A continues the operational action and the targets 4B and 4C have ended the operational action. To discriminate the threat degrees of the targets, it is considered to calculate the inner product of a flying vector of the target 4 which heads for the launcher apparatus 2 and the speed vector of each of the targets 4 and to use the discrimination based on the calculation results. In other words, the target 4 is moving in a forward direction when the inner product is positive, and the target 4 is returning if the inner product is negative.

In case of FIG. 5D, it is considered to primarily intercept the target 4A which is estimated to be continuing the operational action. In this case, it is sufficient to carry out suitable weighting by use of a conversion function and a conversion table so that the threat degree of the target 4 becomes larger when the calculated vector inner product becomes larger. Also, oppositely, it is considered to primarily intercept the target 4B or 4C which is estimated to have ended the operational action. In this case, it is sufficient to carry out the weighting so that the threat degree of the target 4 becomes larger when the calculated vector inner product becomes smaller.

As above, referring to FIG. 5A to FIG. 5D, the numeralization of the threat degree of the target 4 based on the RCS, the turning acceleration, the position of the target in formation and the speed vector has been described. These four references are only an example and other references are not excluded. Also, the numeralization based on different references means the unification of references. Thus, by carrying out the weighting appropriately, the threat degrees of the targets 4 can be compared by combining the references.

A method of calculating the firepower of flying object 3 will be described. There are a maximum speed, a destructive force and so on as references used to numerize the firepower of flying object.

Figure 6:
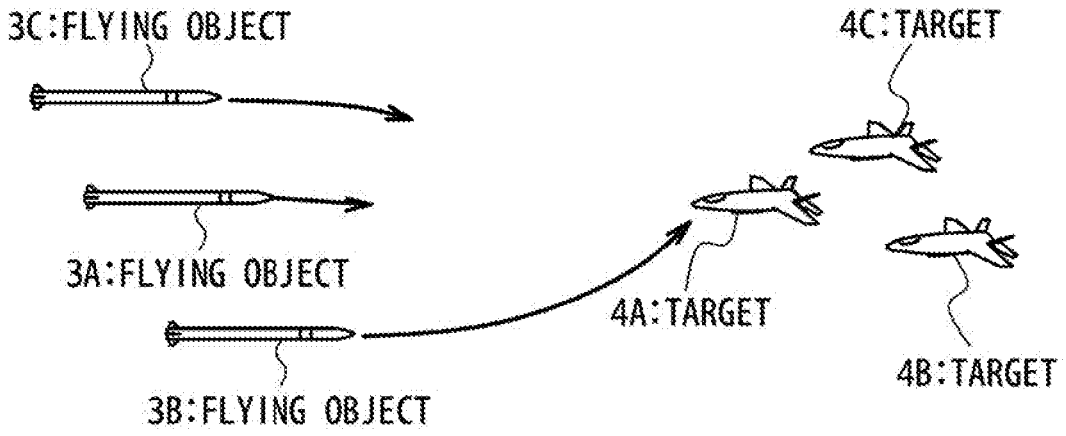
FIG. 6 is a diagram showing the calculation of the performance of flying object based on the maximum speed in the firing control system of the first embodiment.

FIG. 6 is a diagram showing calculation of the firepower of the flying object 3 based on the maximum speed in the firing control system 1 of the first embodiment. It becomes possible for the flying object 3 to intercept the target 4 with a higher mobility when the maximum speed of the flying object 3 is larger. Therefore, it is estimated that the firepower of flying object is high in actuality. The theoretical maximum speed of each of the flying objects 3 may be stored in the storage device 34 of the flying object 3 and the storage device 24 of the launcher apparatus 2 as a database. Or, the flying object 3 may measure the maximum speed by using the sensor device 31, and the launcher apparatus 2 may measure maximum speed by using the sensor device 21.

In an example of FIG. 6, the target 4A has the largest threat degree among the targets 4A to 4C. Also, the flying object 3B has the maximum speed among the flying objects 3A to 3C. In such a case, it is considered that the flying object 3B should intercept the target 4A. In this case, the weighting is carried out by use of a conversion function and a conversion table so that the firepower of the flying objects 3 becomes larger when the maximum speed is larger.

The calculation of the firepower of flying object 3 based on the destructive force of the flying object 3 will be described. It is desirable that the destructive force of the flying object has been measured by using a sample for every model of the flying object 3 or for every manufacturing lot. Since the destructive force of the flying object 3 is in direct correlation with the firepower of flying object 3, it becomes possible to intercept the target 4 with a larger mass, and the target 4 protected by a robust outer wall when the destructive force is larger. Therefore, it is sufficient to carry out the weighting appropriately by use of a conversion function and a conversion table so that the firepower of flying object 3 becomes larger when the destructive force is larger.

As such, it has been described that the firepower of flying object 3 can be numerized based on the maximum speed and the destructive force. These two references are only an example and other references are not excluded. Also, the numeralization using a different reference means the unification of the reference, and the firepower of the flying object 3 can be compared in a combination of a plurality of references by carrying out the weighting appropriately.

According to the firing control system 1 and the firing control method of the embodiments, the optimal assignment in firepower can be carried out based on data acquired after launching the plurality of flying objects 3 in order to intercept the plurality of targets 4. Therefore, it becomes possible to launch the flying objects 3 before the target 4 approaches the neighborhood of the launcher apparatus 2, and to intercept the target 4 efficiently at a sufficiently distant place from the launcher apparatus 2. Also, even if it is detected that a decoy is contained in a plurality of targets 4 after launching the flying objects, it becomes possible to assign the flying object 3 to another target 4 without wasting the flying object 3 assigned to the decoy.

As described above, the present invention has been specifically described with reference to the embodiments. The present invention is not limited to the embodiments and various changes and modification are possible in a range which does not deviate from the gist of the present invention. Also, the features described in the embodiments can be freely combined in the range in which there is not any technical contradiction.

What is claimed is:

1. A firing control system comprising:

a launcher apparatus;

a plurality of flying objects launched for a plurality of targets from the launcher apparatus;

a sensor device configured to observe the plurality of targets; and a first processing unit configured to calculate, after the plurality of flying objects are launched, an optimal assignment of the plurality of flying objects to the plurality of targets based on the observation result, wherein each of the plurality of flying objects comprises:

a first communication device configured to receive a first data signal which contains the optimal assignment calculated by the first processing unit; and a second processing unit configured to set an interception object to one of the plurality of targets which is specified based on the optimal assignment, wherein the plurality of flying objects are configured to share the optimal assignment.

2. The firing control system according to claim 1, wherein at least one of the plurality of flying objects further comprises:

the sensor device; and the first processing unit, and wherein the first communication device transmits the first data signal to a first communication device of another flying object of the plurality of flying objects.

3. The firing control system according to claim 1, wherein the launcher apparatus comprises:

the sensor device;

the first processing unit; and a second communication device configured to transmit the first data signal to the first communication device.

4. The firing control system according to claim 1, wherein at least one flying object of the plurality of flying objects further comprises:

the sensor device, wherein the first communication device transmits a second data signal, which contains the observation result, to the launcher apparatus, and wherein the launcher apparatus comprises:

the first processing unit; and a second communication device configured to transmit the first data signal to the first communication device.

5. The firing control system according to claim 1, wherein the observation result contains data showing an RCS (Radar Cross Section) for each of the plurality of targets, and wherein the first processing unit calculates a threat degree of each of the plurality of targets based on the RCS of each target.

6. The firing control system according to claim 1, wherein the observation result comprises data showing turning acceleration of each target, and wherein the first processing unit calculates a threat degree of each target based on the turning acceleration of each target.

7. The firing control system according to claim 1, wherein the observation result comprises data showing a position of each target in a formation of the plurality of targets, and wherein the first processing unit calculates a threat degree of each target based on the position of each target.

8. The firing control system according to claim 1, wherein the observation result comprises data showing a speed vector of each target, and wherein the first processing unit calculates a threat degree of each target based on the speed vector of each target.

9. The firing control system according to claim 5, wherein the first processing unit calculates firepower of each of the plurality of flying objects such that the larger a maximum speed of each of the plurality of flying objects is, the larger the firepower.

10. The firing control system according to claim 5, wherein the first processing unit calculates firepower of each of the plurality of flying objects such that the larger a destructive force of each flying object is, the larger the firepower.

11. The firing control system according to claim 1, wherein the first processing unit is further configured to choose one of a plurality of optimal assignments of the plurality of flying objects to the plurality of targets calculated by the launcher apparatus or the plurality of flying objects as the optimal assignment.

12. A firing control method, comprising:

launching a plurality of flying objects for a plurality of targets by a launcher apparatus;

observing the plurality of targets by a sensor device;

calculating by a first processing unit, after the plurality of flying objects are launched, an optimal assignment of the plurality of flying objects to the plurality of targets based on the observation result;

receiving a first data signal, which contains the optimal assignment of each of the plurality of flying objects; and sharing the optimal assignment; and setting for each of the plurality of flying objects, an interception object to one of the plurality of targets which is specified by the optimal assignment.

* * * * *